US008146851B2

(12) United States Patent
Malecot et al.

(10) Patent No.: US 8,146,851 B2
(45) Date of Patent: Apr. 3, 2012

(54) CENTRE-FEED ROLL AND PRODUCTION METHODS THEREOF

(75) Inventors: Yves-Michel Malecot, Crosville la Vieille (FR); Joël Hungler, Ailly (FR)

(73) Assignee: Georgia-Pacific France (FR)

( * ) Notice: Subject to any disclaimer, the term of this patent is extended or adjusted under 35 U.S.C. 154(b) by 0 days.

(21) Appl. No.: 12/579,932

(22) Filed: Oct. 15, 2009

(65) Prior Publication Data

US 2010/0032511 A1 Feb. 11, 2010

Related U.S. Application Data

(62) Division of application No. 10/560,493, filed as application No. PCT/FR03/01776 on Jun. 12, 2003, now abandoned.

(51) Int. Cl.
*B65H 18/28* (2006.01)

(52) U.S. Cl. ..... 242/160.4; 242/525; 242/535.1; 242/160.2

(58) Field of Classification Search ..... 242/532.2, 242/535.1, 533.5, 535.3, 535, 525, 525.1, 242/525.6, 526, 541.3, 541, 528, 522, 160.4, 242/160.2, 160.1
See application file for complete search history.

(56) References Cited

U.S. PATENT DOCUMENTS

| | | | | |
|---|---|---|---|---|
| 2,094,454 | A * | 9/1937 | Keville | 206/389 |
| 3,029,035 | A * | 4/1962 | Layton | 242/160.1 |
| 4,487,378 | A * | 12/1984 | Kobayashi | 242/160.1 |
| 4,760,970 | A * | 8/1988 | Larsson et al. | 242/422.5 |
| 5,577,634 | A | 11/1996 | Morand | |
| 5,746,379 | A | 5/1998 | Shimizu | |
| 5,810,279 | A | 9/1998 | Rodriguez et al. | |
| 5,849,357 | A | 12/1998 | Andersson | |
| 6,179,235 | B1 | 1/2001 | King | |
| 6,959,885 | B2 | 11/2005 | King | |
| 2005/0067519 | A1 | 3/2005 | King | |

FOREIGN PATENT DOCUMENTS

| | | | |
|---|---|---|---|
| DE | 2222357 | | 11/1973 |
| DE | 4239574 | A1 | 5/1994 |
| FR | 2554799 | A1 | 5/1985 |
| JP | 01308345 | * | 12/1989 |
| JP | 1308345 | A1 | 12/1989 |
| JP | 06156831 | * | 6/1994 |

OTHER PUBLICATIONS

International Search Report dated Feb. 16, 2004 from PCT/FR2003/001776.

* cited by examiner

*Primary Examiner* — Michael Mansen
*Assistant Examiner* — Juan Campos, Jr.
(74) *Attorney, Agent, or Firm* — Laura L. Bozek

(57) ABSTRACT

The invention relates to a coreless roll including of a sheet made of dry flexible material, such as an absorbent fibrous material, that is formed by the rolling of a sheet around a winding axis characterized in that it includes a center-feed (center unwinding) first strip forming a projection along the axis in relation to at least one part of the plane of one of the sides of the roll. In particular, this first strip is constituted by a portion of the internal end of the sheet constituting the roll. The first internal turn is thus permitted to unwind, even if the center opening is reduced.

5 Claims, 3 Drawing Sheets

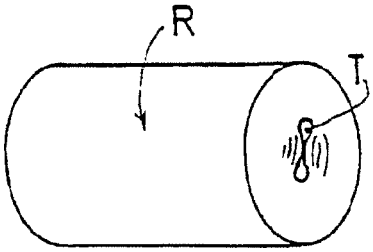
*Prior Art* FIG.1
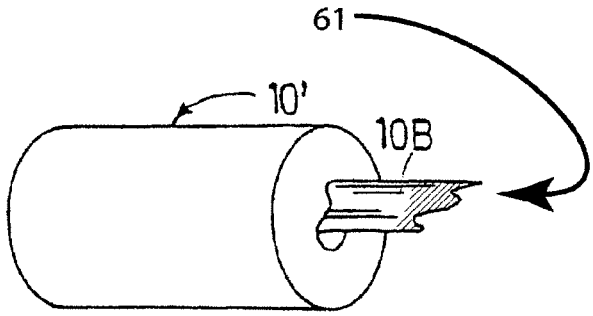
FIG.2
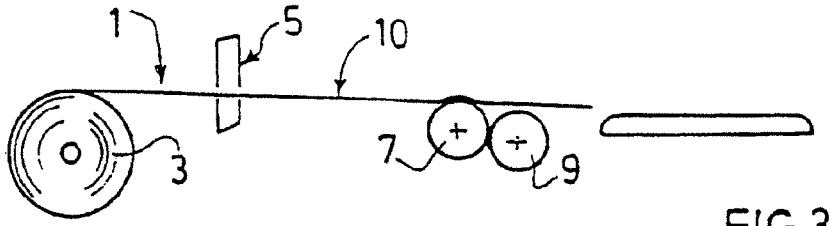
FIG.3
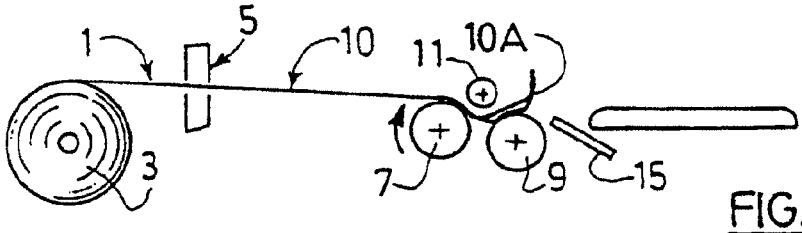
FIG.4
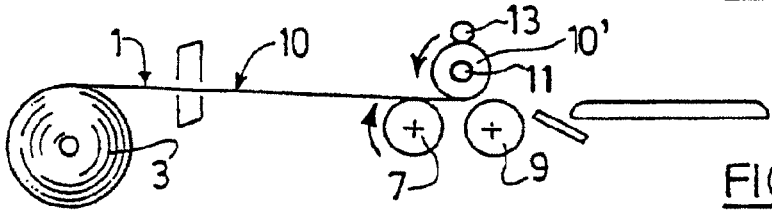
FIG.5
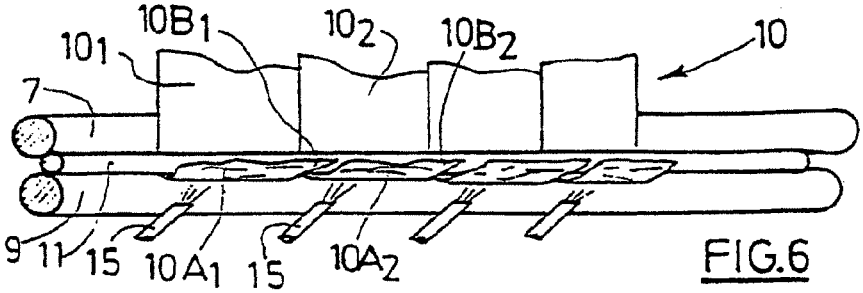
FIG.6

CENTRE-FEED ROLL AND PRODUCTION METHODS THEREOF

CROSS REFERENCE TO RELATED APPLICATIONS

This application is a division of prior U.S. patent application Ser. No. 10/560,493, filed Nov. 7, 2006, which was the National Stage entry of International Application No. PCT/FR2003/001776, filed Jun. 12, 2003, the priorities of which are hereby claimed and their disclosures incorporated by reference in their entirety.

BACKGROUND OF THE INVENTION

The invention relates to a roll of paper or of other similar absorbent material such as a non-woven material intended to be used, for example, for wiping. In particular, it relates to the area of articles for sanitary or household use.

For these applications, the rolls consist of a continuous sheet that may comprise one or several plies, optionally precut into consecutive lengths in the direction of the winding, and rolled axially, preferably about an axis that may either support or not support a core; the roll may also comprise or not comprise a center core. The sheet may be unwound either starting from the external surface of the roll in the direction of the winding or from the interior surface, starting from the center in a direction perpendicular to the direction of the winding of the roll. In this latter case, the roll is said to be a center feed-roll.

The object of this invention is to manufacture rolls that use center unwinding.

When the roll comprises a core, then said core must first be extracted. Generally, the core has been so designed that it can be torn off while pulling on its edge, usually at one of the ends of the cardboard helical spiral that forms it. However, experience has shown that this solution is not always satisfactory, because the extraction of the core sometimes becomes difficult at times if the break-off zone or zones are poorly formed. Furthermore, this action may draw out the first sheets of the roll, which sheets then become difficult to use. Additionally, the first turns of the sheet are frequently glued to the core, making them unsuitable for any type of use and causing them to be discarded as waste.

This core is particularly costly to manufacture, because it is generally composed of two or more layers of cardboard bound by gluing. It is also frequently glued with a "bonding" glue for the first turn of the roll. Furthermore, it is of no use once it is withdrawn and must therefore be discarded as waste.

In order remedy this disadvantage, coreless center-feed rolls have also been proposed. The prior art shows that these rolls are more easily put into service by the user, because it is no longer necessary to remove the core before use. In order to make these rolls, a provisional core may be used, during manufacturing, onto which the sheet may be rolled. The core is then withdrawn before the packaging of the rolls. This technique complicates production at the industrial manufacturing level because it requires the adding of a core removal station to the winding line.

According to one coreless manufacturing process, the sheet is cut on line in the longitudinal direction, before winding, starting from a parent sheet of ample width into as many strips as there are individual rolls to be obtained.

According to another manufacturing process, the parent sheet is rolled directly onto a spindle, also without the insertion of a core. The initial sheet, which is of ample width, is first rolled in such a way as to form one single roll with the definitive diameter of the individual roll, called a "log" in the industry. After the log is formed, the spindle is extracted and the log is cut into sections and then into individual rolls.

However, the sheet, whether made of tissue paper, dry-creped or water-creped, paper by the dry method, or non-woven material, presents a certain elasticity. Owing to the internal stresses of the roll, due for example to the compaction of the sheet onto the spindle during the winding and/or tensioning of the sheet that generates the rolling/unrolling operation by the machine, the reduction of the center opening by the caving in or collapsing at the center of the first turns after the spindle is extracted usually cannot be avoided. This collapsing is produced, for example, after extraction of the spindle and/or at the time of the cutting of the log, by the pressure exerted by the saw.

In any case, a partial or total reduction of the center opening is observed during handling and shipping owing to the inevitable shocks and/or vibrations to which the rolls are subjected.

When the center opening is completely reduced, it is difficult to reshape it with just the hand, and the grasping of the first turn is not easy. Inevitably waste occurs, chiefly when the roll is placed into the dispenser for service, because then the user ends up grasping several turns at once.

It is known from the prior art how to manufacture coreless rolls whose center opening retains its shape after extraction of the spindle and/or after cutting with a saw. For example, a spindle whose profile, grooved or polygonal, can be used, which will permit the formation of an opening whose walls are self-bearing. An exemplary embodiment of this process is disclosed in French Patent No. 2,554,799.

Nevertheless, in this process the diameter of the center opening is small and the first turns are difficult to access. These turns are presented in a tightly-wound, twisted wad with a weak "pitch", hardly conducive to easy use. If the diameter of the center opening is larger, it is difficult to prevent the first turns from becoming attached to one another. For that, a bonding agent is used that is deposited directly onto the sheet or indirectly by way of the spindle or one of the winding cylinders by an adapted system, at the time of rolling of the first turns onto the spindle. Any other principle of attaching the first turns to themselves, chiefly by a mechanical process, is applicable. Thus, these first turns, which collectively resist the forces of the internal stresses, are consolidated.

However, even still, waste cannot be avoided at the time when the roll is placed into service. Whether in the case of direct use or in the case where this roll is used in a center-feed dispenser in which the end of the sheet is introduced into a relatively narrow dispenser opening, the user is obliged to throw away the first turns that have become attached to one another.

Additionally, in this latter type of manufacturing, it cannot be avoided that certain rolls will not be subject to damage during shipping, with the consequent collapsing of the center opening as in the cases mentioned above. In order to avoid this risk, the rolls should also be packaged, preferably rolls in cardboard cases, in contrast to the rolls with core, for which just a flexible wrapping made of paper or plastic is sufficient. The cost is thereby considerably increased.

Accordingly, the interest that these coreless rolls can generate in relation to rolls with a core is greatly diminished.

SUMMARY OF THE INVENTION

The object of the invention is therefore to manufacture a coreless roll composed of a sheet of flexible material, such as an absorbent fibrous material with a total weight basis ranging between 15 and 300 g/m$^2$, preferably between 15 and 100 g/m$^2$, formed by rolling around a winding axis which does not have any of the disadvantages described above.

The absorbent material may be tissue paper, dry-creped or water-creped, paper by the dry method, or non-woven material. It may be composed of one or several plies, attached or not, and optionally precut into lengths.

The material is in the dry state; it is not moist. In particular, it is not impregnated with lotion or with any other liquid.

In accordance with the invention, the roll is characterized in that it comprises a center-feed (center unwinding) first strip forming a projection along the winding axis in relation to at least one part of the plane of one of the sides of the roll. The first strip may be on the axis or slightly set off-center in relation to this axis.

The invention is applied in particular to the rolls whose winding is done under the conditions of high tension of the sheet and of compacting on the winding support, which permit the producing of high meterage rolls but which inevitably lead to the reduction of the center opening.

It is advantageous for the center-feed (center unwinding) first strip to comprise a portion of the internal end of the sheet forming the individual roll.

The solution proposed by the invention allows all the problems related to the reduction of the center opening to be solved because access to the first sheet from the exterior of the roll is permitted. Accordingly, it is no longer necessary to connect the first turns to one another in order to try to maintain the opening formed. Thus waste is also avoided, both at the level of the production machine because of the absence of the turn attachment system, as well as at the time when the roll is placed into service. The rolls may therefore be wrapped in simple flexible packages, chiefly plastic as indicated at 71 in FIG. 8.

In particular, this first strip is formed by the crosswise folding of a portion of the end of the sheet onto the winding axis of the roll; preferably this portion should be tapered as indicated at 41 in FIG. 2A. The additional advantage is thus achieved by facilitating the introduction of the end of the first strip into the dispensing device of the center-feed dispenser, for example.

According to another manufacturing process, the first strip is made by an end portion of the sheet projecting outward in relation to the bottom of a groove or of a recess made in a side and near the winding axis of the roll.

The invention also relates to a process for manufacturing a roll of this type.

According to one feature of the invention, the first strip is made before winding by crosswise folding in relation to its traveling direction of a portion of the front end of the sheet.

This principle is applied in a process with or without a winding support. A spindle is an example of a winding support.

The invention relates in particular to a process comprising the stages in which the sheet is arranged in such a way that this extends outward perpendicular to a winding support, in the proximity of an end of the sheet, then the end of the sheet is folded onto the winding support, a portion of this end is maintained on the winding support, and the latter is placed into rotation around its axis in such a way as to roll the sheet.

According to the invention, before being placed in rotation, the end portion is arranged in such a way that it extends out over one of the side edges of the sheet.

According to another feature, the winding support is placed in relation to the sheet in such a way that one portion of the end of the sheet is arranged on one side of the winding support and the rest of the sheet on the other side; the portion is then moved along on the support with crosswise movement, i.e., in a direction forming an angle other than zero in relation to the direction of the movement of the sheet.

According to another feature, the crosswise movement is provided by the streaming of air.

According to an alternative embodiment, the crosswise movement is effected by the friction of one part on the end portion; this part being displaced with a movement having a crosswise component. The movement of the portion of the end of the sheet may also be effected by the simple rotation of such part.

According to another feature, a wide sheet of flexible material is cut into a plurality of individual sheets arranged side by side; one portion of the end of the individual sheets is moved crosswise, preferably on a same side; the sheets are rolled around a winding support and then each of the rolls thus formed is separated. The portion of the end of the sheets is thus released to the center at the time the rolls are separated.

According to another embodiment of the process, a wide sheet of a flexible material is cut into a plurality of individual sheets by means of a cutting device, the first turn or first turns of the roll is/are first wound, then the cutting device is moved crosswise, and the rest of the sheet is wound to form the roll. The first turn or first turns of the roll is/are thus presented projecting outward onto one of the sides of the roll, the object of the invention.

According to another embodiment of the process claimed by the invention, the first turn or first turns of the roll is/are first wound, the winding support is moved crosswise in relation to the direction of movement of the sheet, and the rest of the sheet is wound to form the roll. The first turn or first turns of the roll are thus presented projecting outward from one of the sides of the roll, the object of the invention.

According to another embodiment of the process, the roll is formed by rolling the sheet onto a winding support, the roll is extracted from the winding support and a portion of the internal end of the sheet is made to slide outside the opening left by the winding support in order to form the first strip before any possible reduction of the center opening.

BRIEF DESCRIPTION OF THE DRAWINGS

The invention will now be described in greater detail with reference to the accompanying drawings, wherein:

FIG. 1 shows a coreless roll from the prior art whose center opening is reduced;

FIG. 2 shows a roll as claimed by the invention with a center-feed (center unwinding) first strip projecting outward along the axis in relation to one of the sides of the roll.

FIGS. 3 to 5 show in diagram form and in a profile view the progression of a sheet in a machine permitting the manufacturing of coreless rolls as claimed by the invention;

FIG. 6 shows the machine according to FIG. 4, viewed from overhead;

DETAILED DESCRIPTION OF THE INVENTION

The roll shown in FIG. 1 is, for example, an absorbent coreless paper roll (R) that is used for wiping either at home or in the workplace. By way of illustration, the paper is, for example, a tissue paper with two plies of 20 g/m$^2$ each, preferably attached. The roll has been obtained by rolling one wide sheet of 2600 mm web width, onto a winding support in the form of a spindle, for example, with a circular section having a diameter of 10 to 80 mm. After formation of a roll, called a "log" in the industry, of 20 cm in diameter, for example, the spindle is extracted and the log is brought to a sawing station. The rolls thus made are then packaged for shipping. The roll has been depicted in FIG. 1 after the walls of the center opening have collapsed in the direction of the center. The opening (T) is reduced until it is completely flattened. At the time when the roll is put into service in a center unwinding dispenser, the internal end of the sheet is released and it is slid into the dispenser opening. This operation is awkward in this case, because the first turns must be pulled out in order to release this end. Waste inevitably occurs as a result of this operation.

Figure 2A:
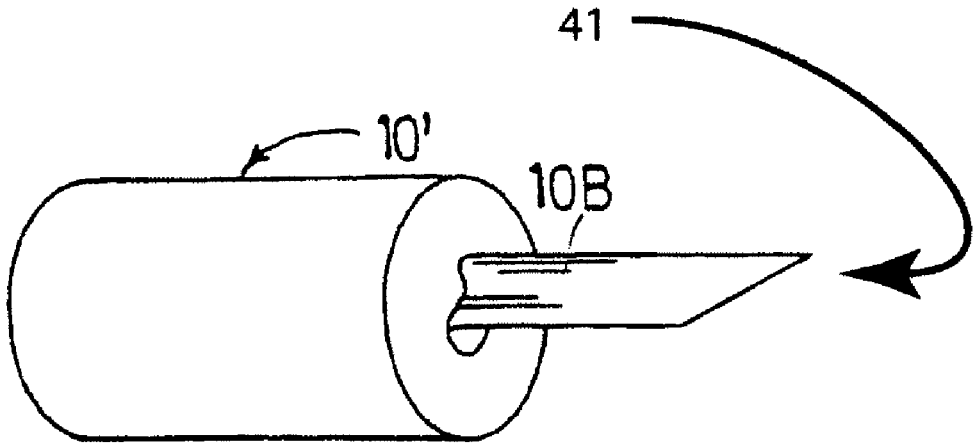
FIGS. 2A and 2B illustrate alternative first strips with a tapered end and a reinforced end respectively.

FIG. 2 shows a coreless roll (10') as claimed by the invention. As in the preceding case from the prior art, the center opening is reduced. However, the placing into service of the roll is greatly facilitated by the solution of the invention which involves forming a center-feed (center unwinding) first strip (10B). This first strip is, according to the simplest embodiment of the invention, comprised by a portion of the internal end of the sheet forming the roll that beforehand has been released, prior to any caving in of the walls of the center opening, and made to project outward in relation to one of the sides of the roll. This first strip may be formed, either at the time of the formation of the roll just before or during the winding of the sheet, or after the roll is made when the opening is still formed, that is to say, just after the cutting, under the existing circumstances, but preferably shortly after such cutting.

It is advantageous for this first strip (10B), measuring 0.3 to 20 cm in length, but preferably 1 to 15 cm, to be formed by a portion of the internal end of the sheet, that is folded in the direction of the winding axis of the roll and made to extend outward over the edge in relation to the side. This first strip thus forms a pointed tip for grasping which is flexible at its end and which may be easily folded against the side of the roll in order to proceed with the packaging of the rolls before shipping. Furthermore, the point is easy to work with and may be easily introduced into the dispenser. The length of the first strip is selected in particular for the ease with which it can be grasped and with which it may be introduced into the extraction opening of the dispenser. The length of the first strip corresponds to the distance between the end of the first strip and the side of the roll.

The first strip may be reinforced by a complementary element, coloring for example as indicated at 61 in FIG. 2.

Figure 2B:
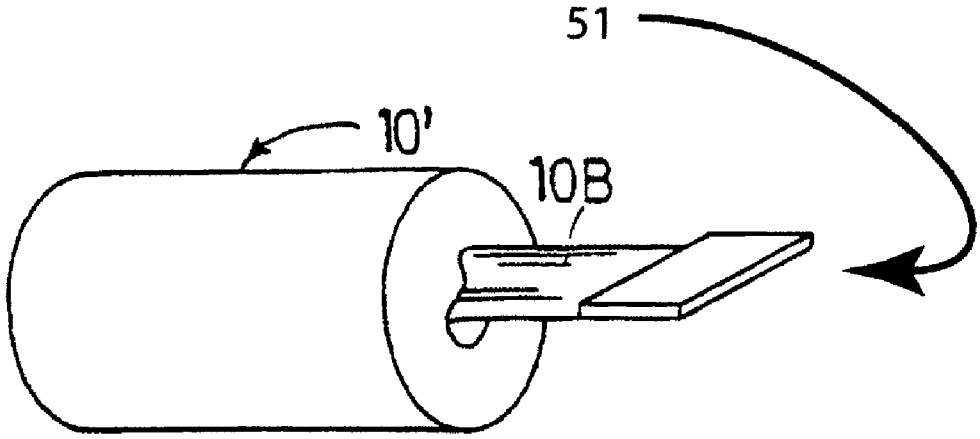

According to one embodiment not shown, the first strip may be reinforced mechanically by a tab or any appropriate means or supplemental element joined onto the sheet and fitted in order to be projecting outward on the axis of the roll as shown in FIG. 2B at 51.

The added element is then placed on the end of the sheet before winding or after separation of the rolls, projecting outward on one of the sides of the roll.

Now a first manufacturing method for the rolls will be described.

The elements of a machine shown in FIGS. 3 to 6 allow the manufacturing of coreless rolls as claimed by the invention. With this machine, a wide sheet (1) coming out from a parent winding (3) is cut on the winding line, before rolling onto a spindle (11). In the industry, the width of the sheet for absorbent paper products is, for example, 2600 mm. The sheet is cut in the longitudinal direction by means of blades (5) arranged in parallel into a plurality of individual sheets (10) whose width corresponds to the width of the individual rolls that are desired to be obtained. The cutting means may be comprised of a series of blades arranged vertically or even of disks operating in conjunction with a support cylinder and cutting the sheet. Other means are known to persons skilled in the art to which this invention pertains.

The sheets (10) are drawn towards a device comprised of two parallel cylinders (7 and 9) and are placed into rotation by motorized means not shown. The two cylinders are spaced slightly one after the other. Once the sheets (10) are in the position shown in FIG. 3, a spindle (11) is put into place by an appropriate means. The spindle then grips the sheets against the cylinders (7 and 9) as shown on FIG. 4. It overlaps the space created between these two contiguous guiding cylinders. The spindle thus delimits from one side an end portion (10A) of the sheets (10). In order to start the rolling of the sheets onto the spindle, a means (15) is provided which folds crosswise the end portion (10A) onto the spindle (11). This means may be comprised of one or several streams of air judiciously positioned. Then, a pressing roller (13) is lowered in order to hold in place the end (10A) of the sheets against the spindle. Once the different mechanisms are in position, the cylinders (7 and 9) are placed into rotation. These cylinders then cause the spindle and the roller 13 to turn on themselves allowing the rolling of the sheet as seen in FIG. 5.

When the rolling phase is completed, the pressing roller is lifted and the spindle is moved with its rolls (10') up to the next station where the individual sheets are cut, parallel to the winding axis, along the entire width of the parent sheet, downstream from the cylinders (7 and 9). The spindle is then extracted from the batch formed by the rolls (10').

According to the invention, the rolls have a center-feed (center unwinding) first strip (10B) projecting outward on the axis, i.e., extending out over the edge in relation to the one of the sides of the roll.

This first strip is manufactured at the time of the rolling of the sheets. As seen in FIG. 6, which is an overhead view of the installation corresponding to the view given in FIG. 4, the spindle (11) is placed on the two cylinders (7 and 9) and gripping the sheet. The sheets ($\mathbf{10}_1$, $\mathbf{10}_2$, . . . ) are arranged below the spindle (11) and their end portions ($\mathbf{10}A_1$, $\mathbf{10}A_2$, . . . ) folded crosswise on said spindle. The means (15), constituted here by streams of air, are inclined on the axis of rotation of the spindle in such a way as to impart to these end portions a motion of crosswise movement in relation to the direction of the movement of the sheets. These end portions ($\mathbf{10}A_1$, $\mathbf{10}A_2$, . . . ) are thus moved in the direction of the winding axis. Thus, each end portion ($\mathbf{10}A_1$) for example, extends out over the edge on the side in the direction of the adjoining sheet, ($\mathbf{10}A_2$). Once they are in this position, the pressing roller (13) immobilizes the different end portions ($\mathbf{10}A_1$, $\mathbf{10}A_2$, . . . ) against the spindle (11). The rolling may begin. At the time of rolling, the part (strip(s)) ($\mathbf{10}B_1$, $\mathbf{10}B_2$, . . . ) extending out over the edge of the end portion of each of the sheets is gripped between the spindle and the first turn of the adjacent roll.

The extending part is released at the time when the spindle is withdrawn. This part ($\mathbf{10}B_1$, $\mathbf{10}B_2$, . . . ) then constitutes the center-feed (center unwinding) first strip for the roll.

The means (15), for folding the end portions on the axis while imparting to them a motion of crosswise movement, has been represented here by streams of air arranged at a certain angle, but not at a right angle, in relation to the winding axis. However, other means are known and may be used by those skilled in the art without departing from the scope and spirit of the invention. Such means may be a brush moving itself in this direction, for example. This means may also be divided into two by a means for the folding movement and a means for the movement in the direction of the winding axis.

According to one alternative embodiment, a wide sheet of flexible material is cut by means of a cutting device into a plurality of individual sheets ($\mathbf{10}_1$, $\mathbf{10}_2$, . . . ) arranged side by side, and the first strip (10B) is made by a crosswise displacement in the direction of the rolling of the sheet (10) of the cutting device. The sheets are then rolled around a spindle (11) and each of the rolls are separated after their formation, the first strips ($\mathbf{10}B_1$, $\mathbf{10}B_2$ . . . ) thus made by the ends ($\mathbf{10}A_1$, $\mathbf{10}A_2$, . . . ) of said sheets are presented projecting outward on one of the sides of the roll.

According to yet another alternative embodiment, the first strip (10B) is made by crosswise displacement in the direction of the sheet (10) of the winding support, the first strips ($\mathbf{10}B_1$, $\mathbf{10}B_2$, . . . ) coming from the end portions ($\mathbf{10}A_1$, $\mathbf{10}A_2$, . . . ) of the sheets coming from the cutting of a wide sheet of flexible material into a plurality of individual sheets ($\mathbf{10}_1$, $\mathbf{10}_2$, . . . ) arranged side by side, are presented projecting outward on one of the sides of the roll after the separation of the rolls.

The crosswise folding may be done irrespective of the direction of one or the other of the edges of the individual sheets ($\mathbf{10}_1$, $\mathbf{10}_2$, . . . ) but preferably it is turned in the same direction as that of the extraction of the spindle.

The length of the projecting first strip 10B depends directly on the length of the end portion 10A and on the folding angle. This length 10B is preferably between 0.3 and 20 cm.

It has been demonstrated that the very slight extra-thickness generated by the refolded first strip on the side of the roll does not affect palletization stability.

The invention may be carried out with any type of spindle or winding support. The profile and the diameter may be of any type, as long as the spindle can be extracted once the rolls are formed.

It is advantageous for the surface condition of the spindle to have an appropriate friction coefficient, as the adding of a lubrication agent turns out to be of no use.

It is not necessary for the width of the sheet to be a multiple of the number of cut sheets. The trim may be advantageously rolled. The roll with less width thus formed then serves as a shock absorber when the spindle is extracted. Then it is eliminated.

This invention also eliminates the need for a bonding agent to protect the cavity of the opening after removal of the spindle. Any possible reduction of the dimension of the center opening before packaging, or even when the shocks or vibrations that might occur during shipping are not prejudicial to the solution claimed by the invention. The grasping first strip (10B) remains available to the end user.

The invention has been described for a machine in which the spindle was supplied after the stopping of the machine. This invention may also be applied in the cases where the changing of the spindle is made without stopping the machine. In the industry, such a machine is called either a "continuous cycle" or a "non-stop" machine. However, the crosswise displacement operation of the end portion of the sheet is in this case more complicated to achieve, since it must be performed within a very short period of time. This difficulty is overcome by reducing, for example, the speed of the machine.

A process has been described with rolling around a spindle. This principle may also be applied to a process that does not call for the use of a winding support.

According to another embodiment of the invention, the formation of a center-feed (center unwinding) first strip is done after formation of the rolls. Those rolls may have been manufactured according to the processes described above, i.e., with cutting on line upstream from the winding.

According to another process, the parent sheet is rolled without slitting on the winding line in order to form a "log" with the width of the parent sheet onto a spindle without core. The spindle is extracted, then the log is cut into sections with the saw.

Then a portion of the internal end of the sheet is withdrawn from the center opening.

For example, a means for carrying out this operation involves introducing into the center opening a cylindrical part whose length and diameter are less than the opening. This part is outfitted with a grasping means for the end of the sheet. It can for example be an evacuation means.

Figure 7:
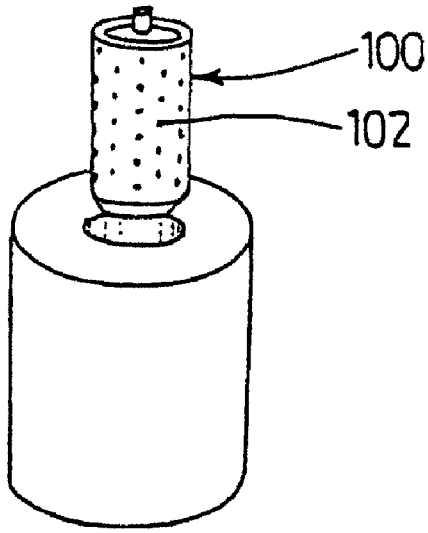
FIG. 7 shows another embodiment of the rolls in accordance with the invention.

An example of an embodiment of this means of extraction of the end portion of the sheet is shown in FIG. 7.

It consists of a cylindrical element (100) connecting by perforations (102) with a vacuum source. The element (100) is introduced into the center opening and an evacuation is created by which the sheet is plated against its wall. The element is turned around its axis, while it is being withdrawn from the opening, in a combined manner, either before or after its extraction from the opening. The end of the sheet is then drawn outside the roll. This part projecting out from the roll constitutes the unwinding first strip (10B). The extraction from this element is stopped when the length of the extracted sheet is considered sufficient. Other means than this evacuation means are possible for those skilled in the art. The separation of the sheet from the cylindrical element is then done by the simple cutting of the evacuation means. If necessary, it may also be accomplished by blowing across these same perforations, or by any other appropriate means.

Figure 8:
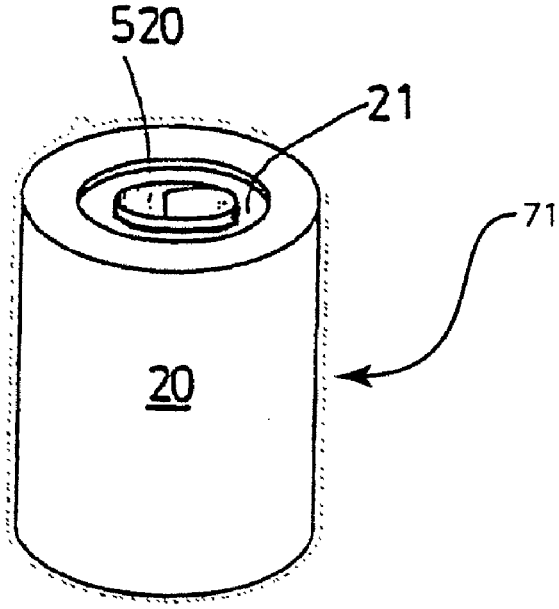
FIG. 8 shows another embodiment of the first strip in accordance with the invention.

Another means for making the first strip is to create a groove or a simple recess on the side of the roll in the proximity of the center opening. FIG. 8 shows that the roll comprising a groove 21 made on the side of the roll 20. This groove consists of a recessed bottom in relation to the side of the roll. The first internal turn or turns 520 extend(s) out from the bottom of the groove, without extending beyond the plane of the rest of the side. This end portion of the sheet, projecting outward in relation to the bottom of the groove, then constitutes a center-feed (center unwinding) first strip.

The manufacturing process for such a roll consists, for example, in cutting by means of a cutting device a wide sheet of flexible material into a plurality of individual sheets arranged side by side. In order to make the groove, a second cutting device, initially aligned with the first is moved transversely then returned to the initial position. The part thus cut off is eliminated. The distance of the crosswise movement determines the depth of the groove that is desired to be made. The sheet length thus cut determines the width of the groove.

Figure 9:
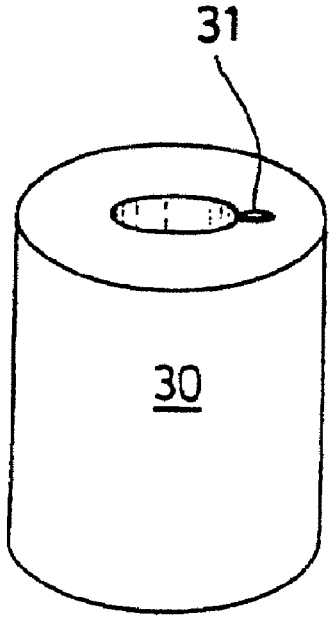
FIG. 9 shows another embodiment of the first strip in accordance with the invention.

FIG. 9 shows the roll 30 with a simple recess 31 instead of a groove. This recess may be made by a cutting tool for example. The portion of the sheet between the center opening of the roll and the groove forms a first strip that may thus be easily grasped.

As our invention, we claim:

1. A manufacturing process for a roll without a winding tube, the roll comprising one sheet of non-moist flexible material with a center unwinding first strip forming a projection along a winding axis in relation to at least one part of at least one side of the roll, said process comprising:

forming the roll by rolling the sheet onto a winding support, extracting the winding support, following the extraction of the winding support, inserting a cylindrical element into a center opening of the roll;

grasping an end portion of the sheet with the cylindrical element;

rotating the cylindrical element; and withdrawing the cylindrical element causing the end portion of the sheet to glide outside the center opening of the roll in order to form the first strip.

2. The process according to claim 1, wherein:

prior to forming the roll, the sheet of flexible material is cut into a plurality of individual sheets arranged side by side, and wherein:

each of the individual sheets are rolled around the winding support to form a plurality of rolls, the plurality of rolls including the roll, and separating the roll from the plurality of rolls prior to inserting the cylindrical element into the center opening of the roll.

3. The process for manufacturing a roll according to claim 1, wherein the process further includes adding to the end portion of the first strip a supplemental element prior to winding or after separation of the roll.

4. A process comprising:

cutting a sheet of flexible material into a plurality of individual sheets arranged side by side, forming a plurality of rolls by rolling each of the individual sheets onto a winding support, extracting the winding support, following the extraction of the winding support, inserting a cylindrical element into a center opening of at least one of the plurality of rolls;

grasping an end portion of at least one of the individual sheets of the at least one of the plurality of rolls with the cylindrical element;

rotating the cylindrical element; and withdrawing the cylindrical element causing the end portion of the at least one of the individual sheets of the at least one of the plurality of rolls to glide outside the center opening of the at least one of the plurality of rolls in order to form a strip projection from the at least one of the plurality of rolls.

5. The process for manufacturing a roll according to claim 4, wherein the process further includes adding to the first strip of each sheet a supplemental element prior to winding or after separation of the roll.

* * * * *